US009310161B2

(12) United States Patent
Ermossa

(10) Patent No.: US 9,310,161 B2
(45) Date of Patent: Apr. 12, 2016

(54) ADJUSTABLE GRIP EXTENDER FOR A FIREARM

(71) Applicant: Moran Ermossa, Jerusalem (IL)

(72) Inventor: Moran Ermossa, Jerusalem (IL)

( * ) Notice: Subject to any disclaimer, the term of this patent is extended or adjusted under 35 U.S.C. 154(b) by 0 days.

(21) Appl. No.: 14/091,513

(22) Filed: Nov. 27, 2013

(65) Prior Publication Data

US 2014/0082983 A1 Mar. 27, 2014
US 2016/0010945 A9 Jan. 14, 2016

Related U.S. Application Data

(63) Continuation-in-part of application No. PCT/IL2012/000212, filed on May 30, 2012.

(30) Foreign Application Priority Data

May 30, 2011 (IL) ..... 213219

(51) Int. Cl.
*F41C 23/00* (2006.01)
*F41C 23/14* (2006.01)
*F41C 23/10* (2006.01)
*F41C 23/16* (2006.01)

(52) U.S. Cl.
CPC ..... *F41C 23/14* (2013.01); *F41C 23/10* (2013.01); *F41C 23/16* (2013.01)

(58) Field of Classification Search
CPC ..... F41C 23/00; F41C 23/10; F41C 23/14; F41C 23/16
USPC ..... 42/71.02, 72–74
See application file for complete search history.

(56) References Cited

U.S. PATENT DOCUMENTS

| | | | | | |
|---|---|---|---|---|---|
| 244,897 | A | | 7/1881 | Holden | |
| 966,165 | A | * | 8/1910 | Cobb | 42/71.02 |
| 2,903,811 | A | * | 9/1959 | Freed | 42/74 |
| 2,933,843 | A | * | 4/1960 | Mcfeeter | 42/85 |
| 3,815,270 | A | * | 6/1974 | Pachmayr | 42/71.02 |
| 4,586,282 | A | * | 5/1986 | Sniezak | 42/71.02 |

(Continued)

FOREIGN PATENT DOCUMENTS

DE 3743092 C2 7/1988

OTHER PUBLICATIONS

International Search Report from the PCT application that this application claims priority to, 1 page, mailed Sep. 27, 2012.

*Primary Examiner* — Stephen M Johnson
*Assistant Examiner* — Benjamin Gomberg
(74) *Attorney, Agent, or Firm* — Roach Brown McCarthy & Gruber, P.C.; Kevin D. McCarthy

(57) ABSTRACT

An adjustable grip extender for a firearm, comprising: a) an elevating mechanism, including a moveable portion on top and a fixed portion on bottom with respect to the adjustable grip, wherein both portions are pivotally connected in such a way that said moveable portion can be moved angularly with respect to said fixed portion, wherein the bottom surface of said adjustable grip extender is attached to the handle of the firearm in a position that allows a user's trigger finger to rest on said moveable portion for positioning the distal portion of said finger directly in front of the trigger of said firearm and substantially perpendicular to said trigger; and b) an adjustable mechanism for setting the elevating degree of said moveable portion in a fixed position, by changing the relative angular position between said moveable portion and said fixed portion.

17 Claims, 15 Drawing Sheets

(56) References Cited

U.S. PATENT DOCUMENTS

| | | | | | |
|---|---|---|---|---|---|
| 4,887,374 | A | * | 12/1989 | Santarossa | 42/73 |
| 5,075,995 | A | | 12/1991 | Kennel | |
| 5,231,237 | A | | 7/1993 | Cupp | |
| 5,946,842 | A | * | 9/1999 | Nyzell et al. | 42/72 |
| 6,073,381 | A | * | 6/2000 | Farrar et al. | 42/71.02 |
| 6,112,446 | A | | 9/2000 | Forster | |
| 6,802,148 | B1 | | 10/2004 | Danas | |
| 6,804,907 | B1 | * | 10/2004 | Slobodkin | 42/71.02 |
| 8,186,089 | B2 | * | 5/2012 | Werner et al. | 42/71.02 |
| 2005/0188587 | A1 | | 9/2005 | Danas | |
| 2008/0047188 | A1 | | 2/2008 | Lindstrom | |

* cited by examiner

ADJUSTABLE GRIP EXTENDER FOR A FIREARM

FIELD OF THE INVENTION

The present invention relates to the field of firearms. More particularly, the invention relates to an adjustable grip for enabling the user to improve target accuracy and consistency while shooting with a firearm.

BACKGROUND OF THE INVENTION

Many types of grips have been devised for attachment to firearms or pistols to enable a user to better hold and aim the firearm, or to reduce recoil or otherwise improve the comfort when the firearm is held and fired with consistent accuracy. The use of elastomers in the grip assembly provides for a better "feel" in the user's hand and may provide a certain amount of bulk or sizing to otherwise standard factory produced grips.

U.S. Pat. No. 6,802,148 discloses a target grip for a firearm which comprises insertable and removable trigger finger support inserts for a side panel of the grip for enabling the distal portion of a user's trigger finger to contact a trigger perpendicular to the trigger for more shooting accuracy and consistency. Various size trigger finger target grip extender inserts may be inserted into the firearm grip and removed until the proper size insert is found. The target grip extender insert is secured by a friction fit or by a clip on the end of the insert. However, in order to fit the gripping of the firearm for different users, several grip extender inserts are required with each side panel to vary the placement of the distal end of a user's trigger finger and to enable the trigger finger to be placed in front of the trigger approximately perpendicular to the side of the trigger of the firearm.

Other attempts to provide an enhanced grip for a fire firearm were suggested, such as disclosed in U.S. Pat. No. 6,112,446 or U.S. Pat. No. 5,231,237. However, none of them provide a placement of a trigger finger with consistency on the weapon trigger or any adjustment for positioning a trigger finger of a user.

None of the above patents disclose the structural features of the present invention, which is intended to improve (or replace) the standard side panels of a firearm to improve proper placement of the trigger finger on the trigger.

To address this problem and to provide more accurate results while using a firearm, an enhanced grip with personal configuration and fitting is required.

Accordingly, it is therefore an object of the present invention to provide a single grip extender capable of providing various size contoured adjustments to the frame of a firearm, enabling the user to improve target accuracy and consistency.

It is another object of this invention to provide a left or right side panel on the frame of a firearm, having an adjustable extension to allow the trigger finger to be placed on the trigger allowing only the distal portion of a user's trigger finger to contact the trigger.

It is a further object of this invention to provide an adjustable extension on a side panel of a firearm to enable the trigger finger to rest on the trigger from a direction substantially perpendicular to the trigger.

It is yet another object of the invention to provide an adjustable extension having a different size contoured outward extension for allowing easily custom fitting of the user's finger length and particularly positioning the distal portion of the trigger finger of the user to be substantially perpendicular to the trigger at the same position on the trigger for each firing.

Other objects and advantages of the invention will become apparent as the description proceeds.

SUMMARY OF THE INVENTION

The present invention relates to an adjustable grip extender for a firearm, comprising: a) an elevating mechanism, including a moveable portion on top and a fixed portion on bottom with respect to the adjustable grip, wherein both portions are pivotally connected in such a way that said moveable portion can be moved angularly with respect to said fixed portion, wherein the bottom surface of said adjustable grip extender is attached to the handle of the firearm in a position that allows a user's trigger finger to rest on said moveable portion for positioning the distal portion of said finger directly in front of the trigger of said firearm and substantially perpendicular to said trigger; and b) an adjustable mechanism for setting the elevating degree of said moveable portion in a fixed position, by changing the relative angular position between said moveable portion and said fixed portion.

According to an embodiment of the invention, the adjustable mechanism includes a screw having a head section and a threaded section, wherein the head section of said screw is connected to said moveable portion through a corresponding opening at the moveable portion and the threaded section is screwed into a corresponding nut housing located at the fixed portion, thus the elevating degree is set by turning said screw in a right or left direction, such that only the turning of said screw will result in lowering or raising said moveable portion.

According to an embodiment of the invention, the screw is attached to the elevating mechanism in such a way that the distal end of said screw (i.e., the threaded section) is screwed into the corresponding nut housing located on the fixed portion, while being threaded through a suitable opening on the moveable portion.

According to an embodiment of the invention, the corresponding nut housing is axially connected to the fixed portion, thereby allowing the movement of said nut housing while lowering or raising the moveable portion when turning the screw left or right, for enhancing the movement of the moveable portion.

According to an embodiment of the invention, the elevating mechanism is covered with an elastic material shaped in an ergonomic manner for providing comfortable and enhanced grip of the firearm by a user's hand, and accurate firing by allowing the user's trigger finger to return to same position after each firing. The elevating mechanism can be made from a rigid and/or semi rigid material(s). Furthermore, the shape of the elevating mechanism provides accurate firing by allowing the user's trigger finger to return to the same position after each firing.

According to an embodiment of the present invention, a standalone side panel, provided with said adjustable grip extender, and is adapted to replace a standard factory side panel of a firearm. Alternatively, the adjustable grip extender can be attached to an original or a standard factory side panel of a firearm using any suitable attaching means, such as adhesion techniques, securing screws or combination thereof. According to some embodiments of the present invention, a side panel of a firearm can be manufactured with said adjustable grip extender integrated thereon.

According to an embodiment of the invention, a standalone side panel provided with said adjustable grip extender is adapted to replace the original handle, handle cover or side panel portion of the firearm.

According to an embodiment of the invention, the adjustable grip extender is attached to an original or a standard factory side panel of a firearm using any suitable attaching means or arrangement. According to an embodiment of the invention, the attaching means are selected from the group consisting of: adhesion techniques, securing screws, clips, tension clips, or any combination thereof.

According to an embodiment of the invention, the attaching arrangement is formed like an open shape that surrounds the firearm's handle and on which said adjustable grip extender is embedded, wherein said open shape having two ends that are facing each other, thus said attaching arrangement is formed in such a way that it wraps or covers, at least partially, the side panels of said handle, and wherein said attaching arrangement is secured to said firearm, by fastening the ends of said attaching arrangement with a securing member that connects said ends.

According to an embodiment of the invention, the securing member is a screw that passes through the trigger guard of the firearm and behind the trigger of said firearm, such that said screw avoids any interruption to the operation and movement of said trigger while shooting with said firearm.

According to an embodiment of the invention, the attaching arrangement includes an insert adapted to be inserted into a relatively narrow slit that exists between the firearm's magazine and the magazine housing at the bottom of the firearm's handle while the magazine is inserted.

According to an embodiment of the invention, the attaching arrangement is made one or more elements.

The firearm is selected from the group consisting of handguns, revolvers, semiautomatic handguns, rifles, shotguns and any other firearm or similar weapons having a side panel suitable to attach said adjustable grip extender thereon.

According to an embodiment of the present invention, the angular elevating mechanism further comprises an elevation limiting means for limiting the elevating of the moveable portion.

According to an embodiment of the present invention, the outer shape of the adjustable grip extender is configured in such a way that it improves proper placement of the trigger finger on the trigger. Furthermore, the outer shape of the grip provides a much better grip of the firearm by the user's hand, as the structural shape of said adjustable grip leaves almost no empty space between the user's hand and the side panel, and thereby it may completely eliminate the tendency to move the firearm right or left while a user pulls the trigger of said firearm. Moreover, the outer shape of said grip is configured in such a way that said grip allows the user to grab the side panel of the firearm with his entire palm and fingers, except the portion of the trigger finer that is placed on the trigger.

DETAILED DESCRIPTION OF PREFERRED EMBODIMENTS

Throughout this description the term "firearm" is used to indicate a weapon that launches one or more projectile(s) at high velocity through confined burning of a propellant. This term does not imply any particular shape, construction material(s) or geometry, and invention is applicable to all suitable firearms, such as gun, handgun, pistol, revolvers and the like.

Reference will now be made to several embodiments of the present invention(s), examples of which are illustrated in the accompanying figures. Wherever practicable, similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
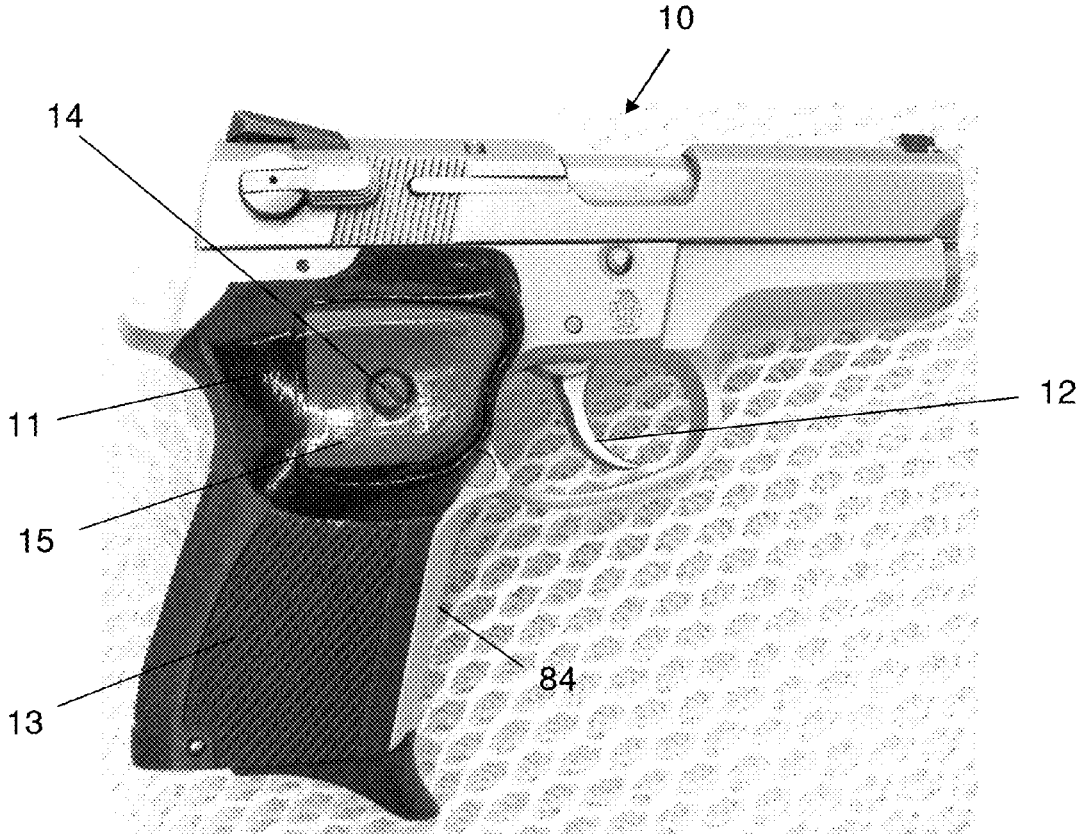
FIG. 1 schematically illustrates a side view of a firearm provided with an adjustable grip extender, according to an embodiment of the present invention.

Referring to FIG. 1, an adjustable grip extender 11 according to an embodiment of the present invention is shown attached to a handle 84 of a firearm 10. The adjustable grip extender 11 is used for custom fitting of a user's trigger finger approximately perpendicular to a trigger 12 of firearm 10. As shown in the figure, the handle 84 of firearm 10 is having a side panel (as indicated by numeral 13) upon which the adjustable grip extender 11 is attached. In this embodiment, the adjustable grip extender 11 is attached to the handle 84 of firearm 10 in such a way that the user's trigger finger will be approximately perpendicular to trigger 12. In this context, the term "trigger finger" means the finger which is used to operate the trigger of a firearm.

According to an embodiment of the present invention, the adjustable grip extender 11 is having a top surface 15 which is moveable and a bottom surface which is attached to the side panel 13. The adjustable grip extender 11 includes an angular elevating mechanism operated by a screw 14 or other suitable leveraging element. Turning screw 14 left or right rises or lowers, in an angular manner, the moveable top surface 15. An angular elevating mechanism that can be used in conjunction with the invention is described in further details with respect to FIG. 2A herein below.

The adjustable grip extender 11 illustrated in this figure is particularly convenient because it can be applied as an ad-on device to existing firearm without the need to carry out any alterations in the structure of the firearm as will be described in further details with respect to FIGS. 7, 8A-8C and 9A-9D hereinafter. The adjustable grip extender 11 can be attached to the original or the standard factory side panel of a firearm. For example, the adjustable grip extender 11 can be attached to a standard factory side panel of the firearm by any suitable attaching means, such as adhesion techniques, securing screws, clips, etc. According to some embodiments of the invention, the adjustable grip extender 11 can be provided with an exchangeable side panel that is intended to replace the standard/original factory side panel of the firearm. Alternatively, a firearm can be manufactured with the adjustable grip extender 11 integrated thereon.

The present invention may be used on handguns, revolvers, semiautomatic handguns, rifles, shotguns and any other firearm or similar weapons having a side panel suitable to contain the adjustable grip extender 11 thereon.

Figure 2A:
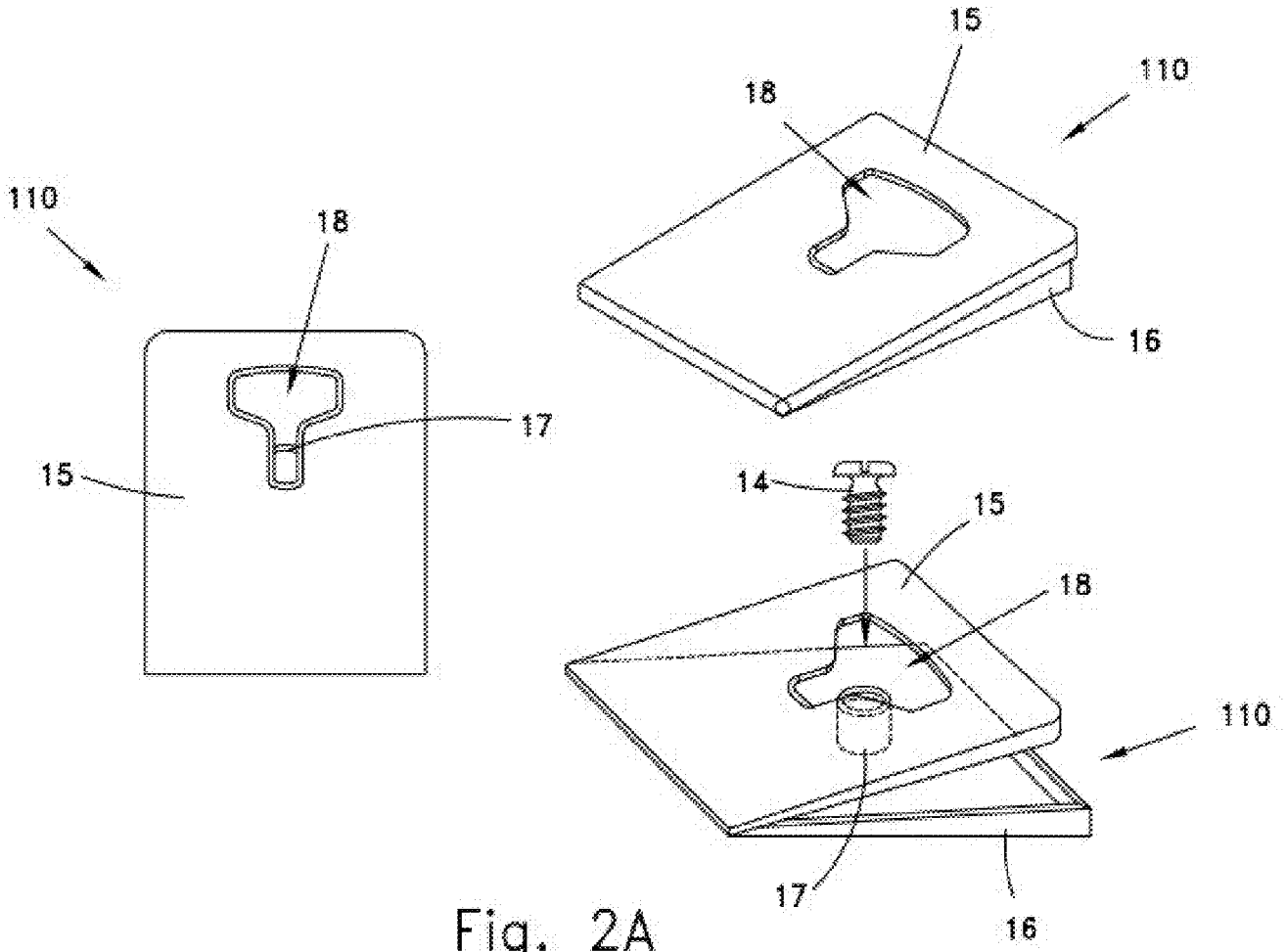
FIG. 2A schematically illustrates a perspective view of an angular elevating mechanism of the adjustable grip extender, according to an embodiment of the present invention.

Referring to FIG. 2A, a perspective view of an angular elevating mechanism 110 of adjustable grip extender 11 is shown, in accordance with an embodiment of the present invention. The angular elevating mechanism 110 comprises a moveable portion 15 on top and a fixed portion 16 on bottom, wherein both portions 15 and 16 are pivotally connected in such a way that the moveable portion 15 moves in an angular manner with respect to the fixed portion 16. The bottom surface of the adjustable grip extender 11, where the fixed portion 16 is located, is directed to be attached or mounted on top of the side panel 13 of the firearm 10.

In this embodiment, the angular elevating mechanism 110 is configured in a wedge-like form. According to an embodiment of the present invention, both portion 15 and 16 have a wedge-like form wherein the thinnest side of both portions 15 and 16 are the ones that are pivotally connected. The elevating mechanism is made of one or more rigid and/or semi rigid materials, such as metal or plastic.

The angular level of the moveable portion 15 is adjusted (i.e., changes its angular position with respect to the fixed portion 16) by turning the screw 14 in a right or left direction. Screw 14 is attached to the elevating mechanism 110 in such a way that the distal end of screw 14 is screwed into a corresponding nut housing 17 located on the fixed portion 16 (or on the bottom of the adjustable grip extender 11), and this while the head of screw 14 become connected to the moveable portion 15. Thereby, any turning of screw 14 results in the lowering or the raising of the moveable portion 15 (i.e., the screw 14 is screwed or unscrewed within the housing 17). In this embodiment, the nut housing 17 is fixed to the fixed portion 16. The nut housing 17 can be provided in such a way that it will be able to partially move as will be described with respect to FIG. 6.

As will be appreciated by a skilled person, the head section of screw 14 can be attached to the moveable portion 15 in several ways that will allow its left and right rotation, e.g., screw 14 can be threaded through an opening 18 in the moveable portion 15, while the head of screw 14 will be grasped by the opening 18 of to the moveable portion 15. The inner surface of moveable portion 15 may further comprise a slit adapted to accommodate the head section of screw 14. Thus, sliding the head section of screw 14 into such slit will grasp screw 14 in such a manner that it will become attached to the moveable portion 15 while still being able to freely rotate left or right within such slit. Alternatively, the moveable portion 15 can be provided with a built-in screw.

Figure 2B:
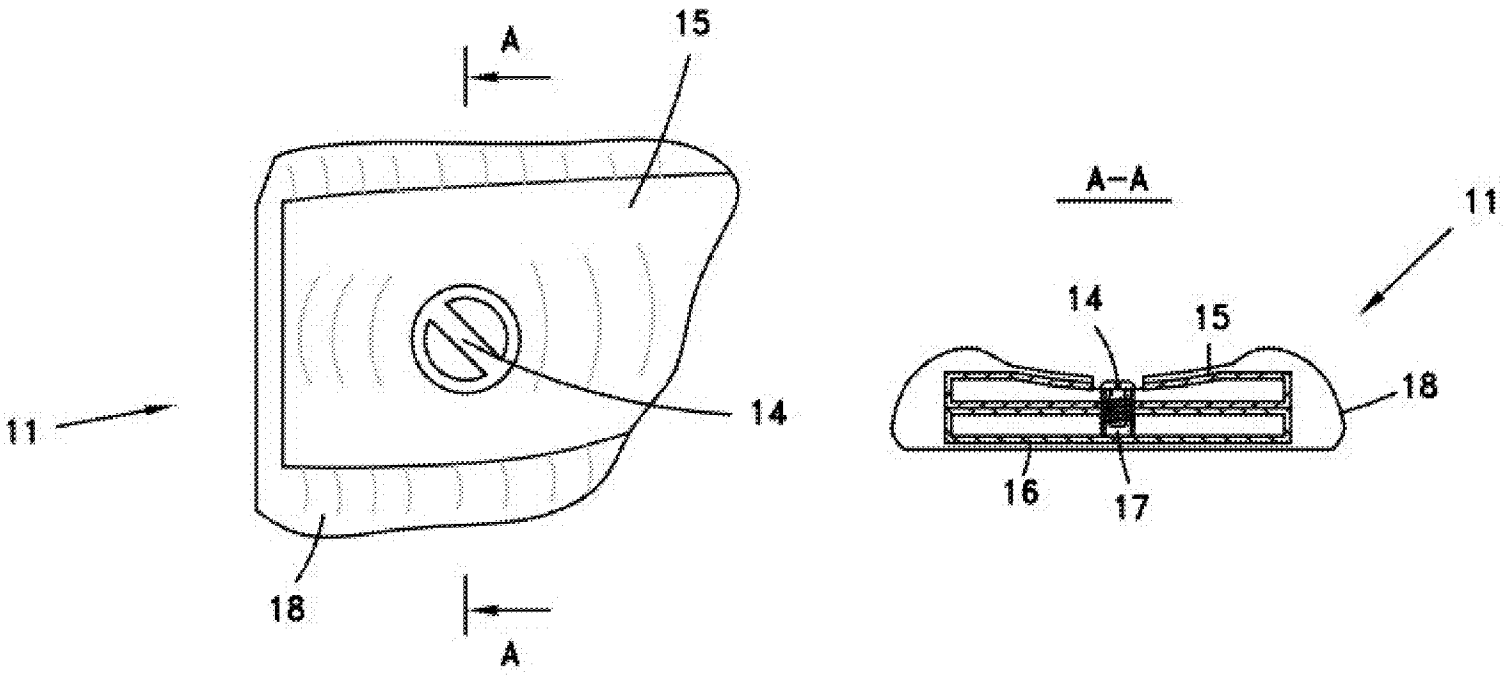
FIG. 2B schematically illustrates the adjustable grip extender, according to an embodiment of the present invention.

According to an embodiment of the present invention, the top surface of the adjustable grip extender 11 is shaped to fit a portion of the trigger finger in a comfort manner and for providing an enhanced gripping of the firearm. FIG. 2B schematically illustrates a cross sectional view A-A of the adjustable grip extender 11, according to an embodiment of the present invention. In this embodiment, the adjustable grip extender 11 comprises the elements of the elevating mechanism 110 (as shown in FIG. 2A hereinabove) covered with an elastic material 18. The elastic material 18 is shaped in an ergonomic manner in order to provide a comfortable and an enhanced grip of the firearm by a user's hand. Optionally, the top surface of the moveable portion 15 can be perforated (not shown) in order to better grip the elastic martial used for the covering of the elevating mechanism 110 (e.g., when the covering is done by a pouring process while using a type of a hardened foam).

Figure 3:
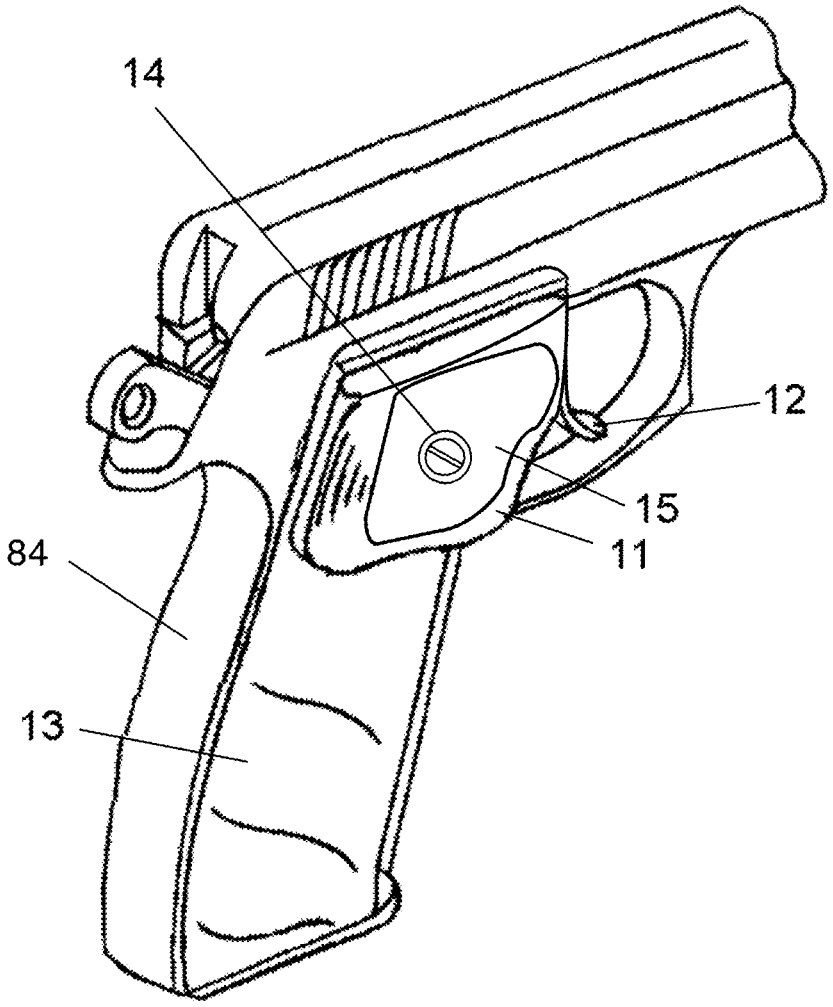
FIG. 3 schematically illustrates a perspective view of a firearm provided with the adjustable grip extender, according to an embodiment of the present invention.

Referring to FIG. 3, a perspective view of the side panel 13 of the firearm 10 is shown having the adjustable grip extender 11 for positioning a right hand trigger finger on the trigger 12. The moveable portion 15 is shown extending outward and toward the trigger 12 to enable the distal portion of the user's trigger finger to arrive at a right angle to the side of the trigger 12 and in front of the trigger 12. Screw 14 is used for adjusting the extending level of the moveable portion 15.

Figure 4:
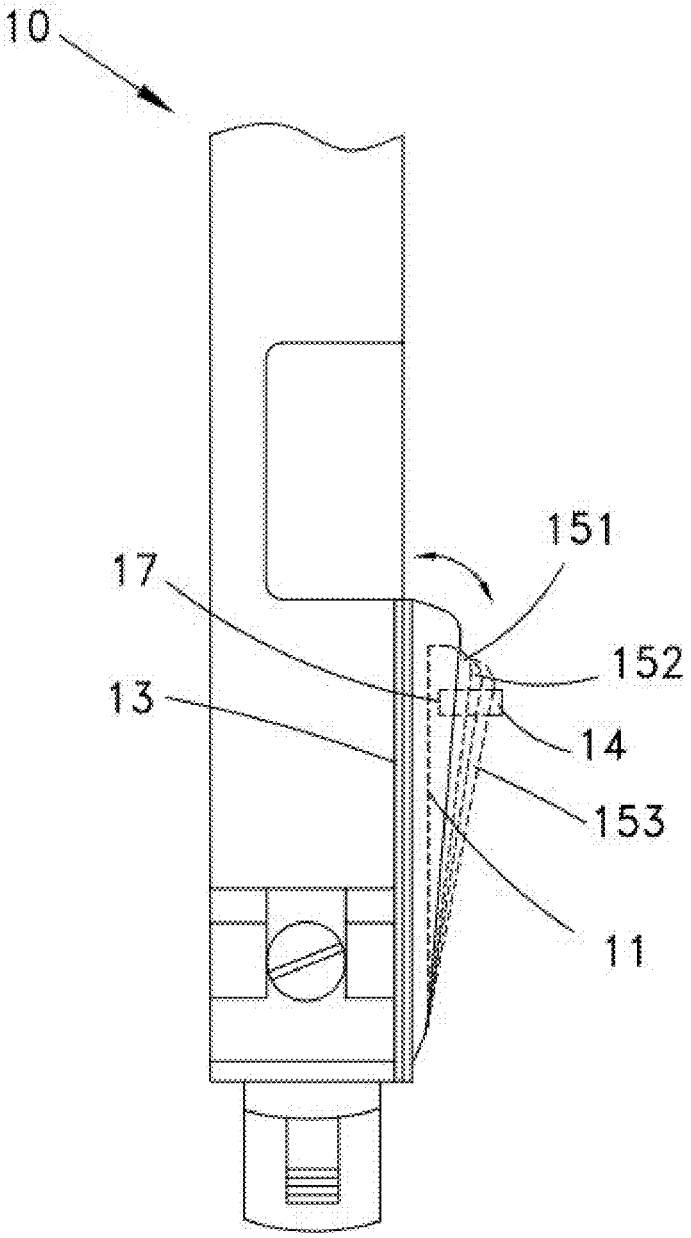
FIG. 4 schematically illustrates a top view of the firearm with different positions of the angular elevating mechanism of the adjustable grip extender, according to an embodiment of the present invention.

Referring to FIG. 4, a top view of the firearm 10 is shown indicating various positions of the moveable portion 15 of the adjustable grip extender 11 (as indicated by numerals 151, 152 and 153). This arrangement allows custom fitting of a user's right hand trigger finger distal portion to arrive at approximately a right angle to the side of the trigger 12 and in front of the trigger 12. In practice, the desired position or level of moveable portion 15 is set, by turning screw 14, until the correct fit is found for the distal portion of the trigger finger of the user. Usually the correct fit set when the trigger finger is perpendicular to and in front of the trigger 12.

The adjustable grip extender 11 should fit different sizes of users' hands and variety of lengths of users' fingers. For example, the adjustable grip extender 11 can be configured in such a way that the thickness of the adjustable grip extender 11 in its thinness form (i.e., whenever the distance between the moveable portion 15 and the fixed portion 16 is minimal) can be about 0.5 cm, while the maximum thickness can be increased (by distancing the moveable portion 15 from the fixed portion 16 by turning screw 14) up to additional few millimeters. Of course, the adjustable grip extender 11 can be configured in other thickness and dimensions in order to fit a variety of sizes of user's hands and fingers.

Figure 5A:
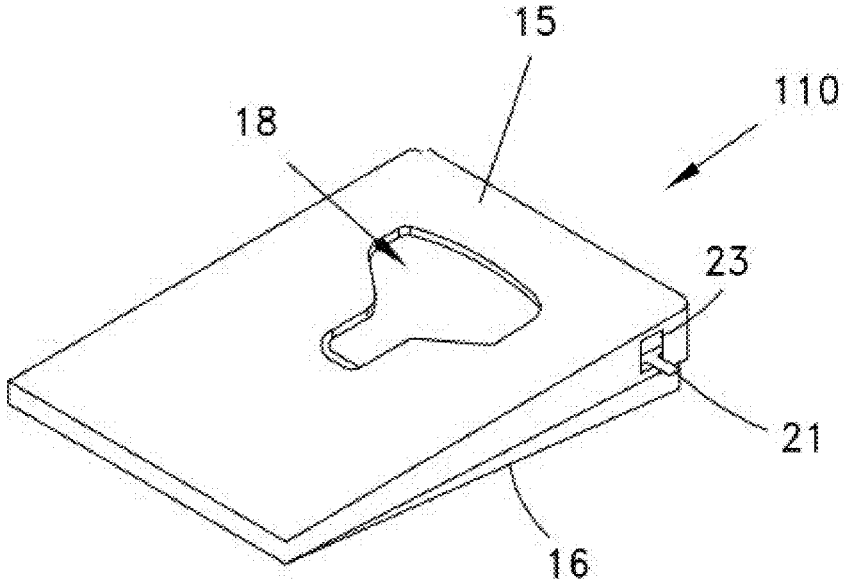
FIGS. 5A and 5B schematically illustrates a perspective view of an angular elevating mechanism of the adjustable grip extender provided with elevating limiting means, according to an embodiment of the present invention.
Figure 5B:
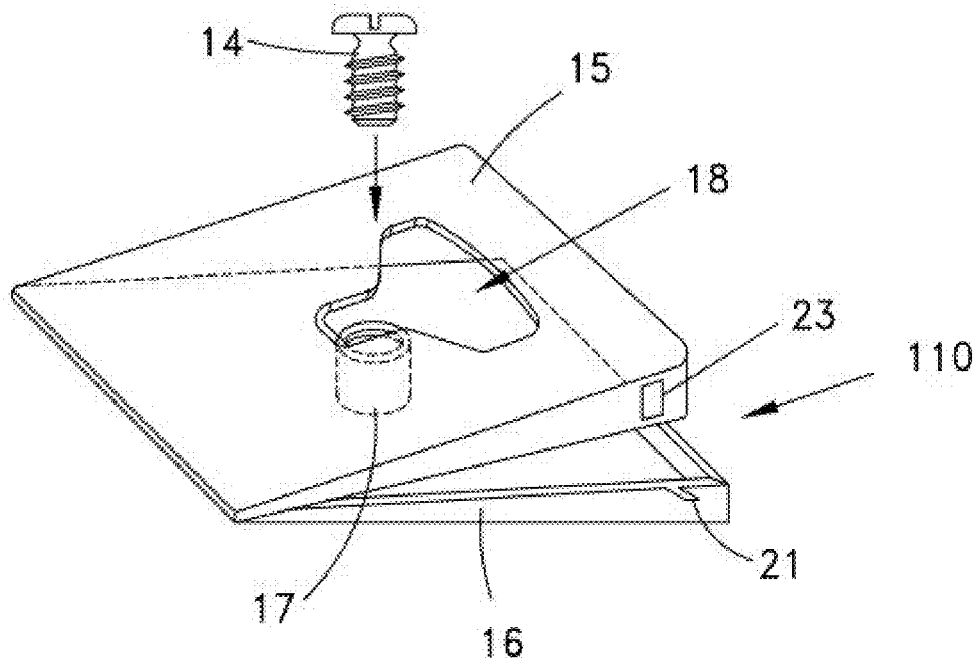

In some cases, it is required to limit the maximum opening of the moveable element 15, in order to avoid a complete opening of the angular elevating mechanism 110. Referring now to FIGS. 5A and 5B, a perspective view is shown of a second embodiment of the angular elevating mechanism 110 provided with an elevating limiting means. The elevating limiting means comprises a blocker 21 at one side of the distal end of the fixed portion 16 and a corresponding slit opening 23 located at same side of the distal end of the moveable portion 15. The engagement of blocker 21 within the slit opening 23 results in an arrangement that can be used for limiting the elevating (i.e., the adjustment) of the moveable portion 15, as the blocker 21 limits the angular movement of the moveable portion 15 (this is seen easily in FIG. 5A).

Optionally, pulling out blocker 21 from the slit opening 23 will cause the moveable portion 15 to open, as shown with respect to FIG. 5B (e.g., for removal or disassembly of the angular elevating mechanism 110, if required).

Figure 6:
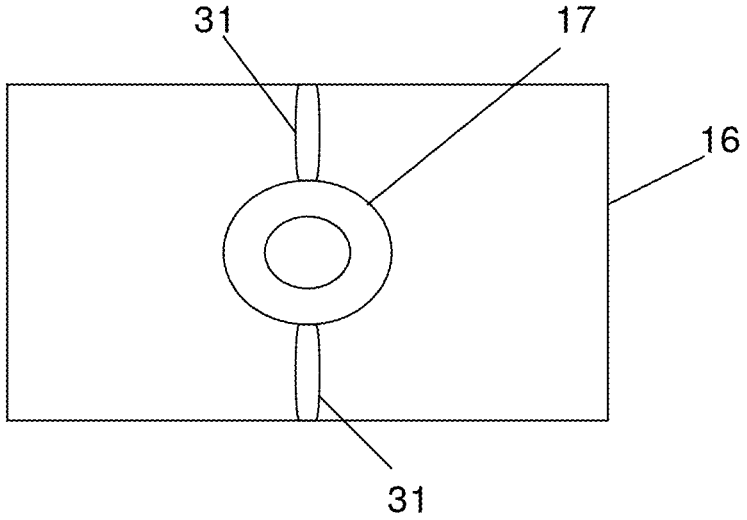
FIG. 6 schematically illustrates a top view of a moveable nut housing attached to fixed portion of the elevating mechanism for enhancing the adjustment of its moveable portion, according to an embodiment of the present invention.

Referring now to FIG. 6, an enhanced mechanism for connecting the nut housing 17 to the fixed portion 16 is shown, with respect to an embodiment of the present invention. In this embodiment, the nut housing 17 is axially connected via axis 31 to the fixed portion 16, thereby allowing its movement around axis 31. This arrangement enhance the movement of the moveable portion 15 while screw 14 is being screwed or unscrewed while its threaded section is located within housing 17. Such arrangement, allows the housing 17 to move forward or backward with respect to the raising or the lowering of the moveable portion 15 (i.e., with respect to direction of the angular movement of the moveable portion 15).

Figure 7:
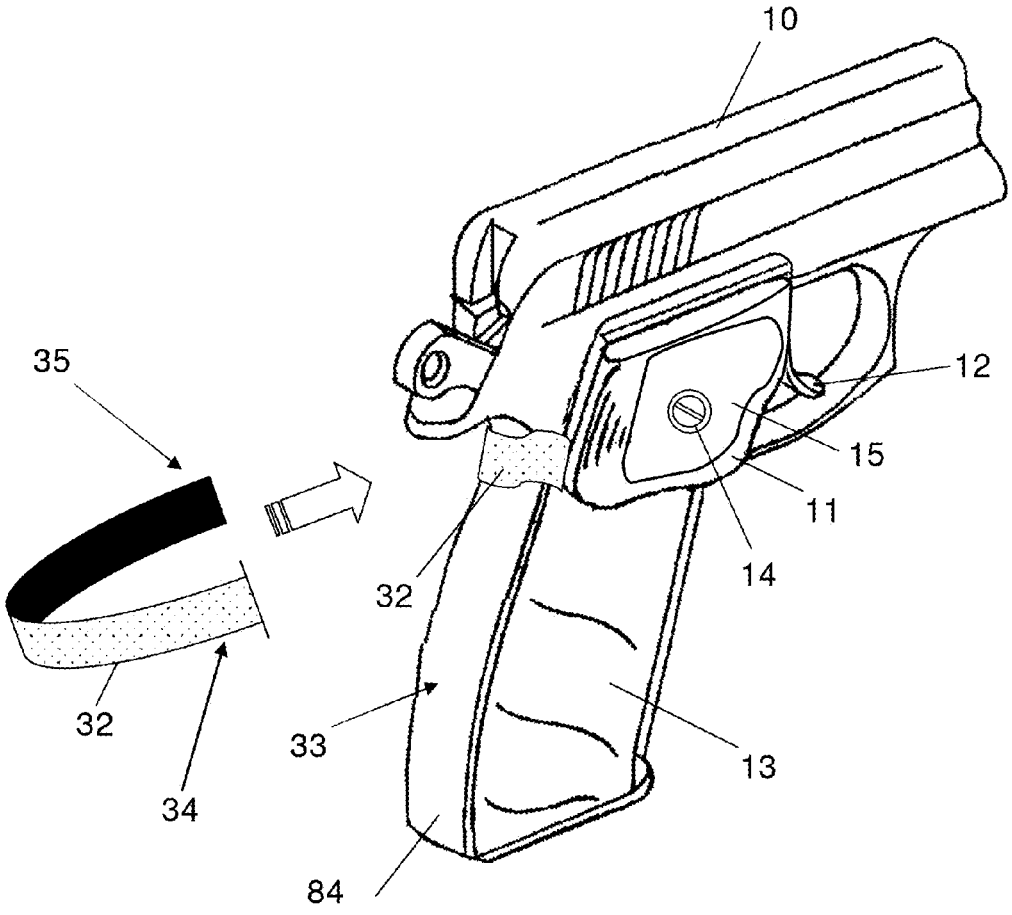
FIG. 7 schematically illustrates a perspective view of attaching the adjustable grip extender to the firearm using a tension clip, according to an embodiment of the present invention.

According to some embodiments of the present invention, the adjustable grip extender 11 can be attached to the firearm 10 using an attaching means or arrangement such as a tension clip 32, as shown with respect to FIG. 7. In this embodiment, the tension clip 32 is mounted on the handle 84 of the firearm 10 from its rear side (as indicated by numeral 33). In such embodiment, the adjustable grip extender 11 is provided with such tension clip attached to its bottom surface. The tension clip 32 is made of rigid material such a suitable polymer or metal. The tension clip 32 can be further secured to the firearm, by engaging or fastening both of its ends 34 and 35 around the handle 84 of the firearm (not shown). For example, this can be done by using a screw, Velcro, or other suitable fastening means.

Figure 8A:
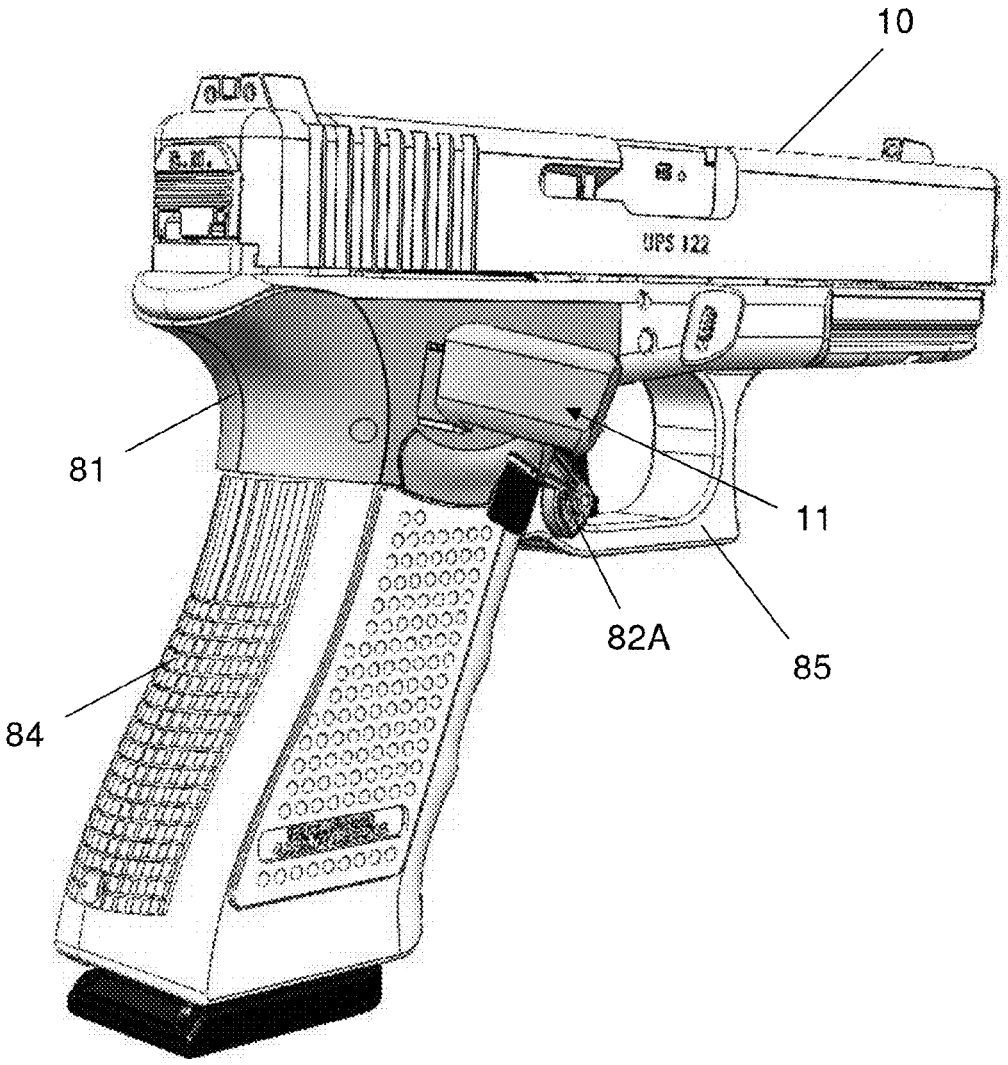
FIGS. 8A-8C schematically illustrate an attaching arrangement that attaches the adjustable grip extender to the firearm, according to some embodiments of the present invention.
Figure 8B:
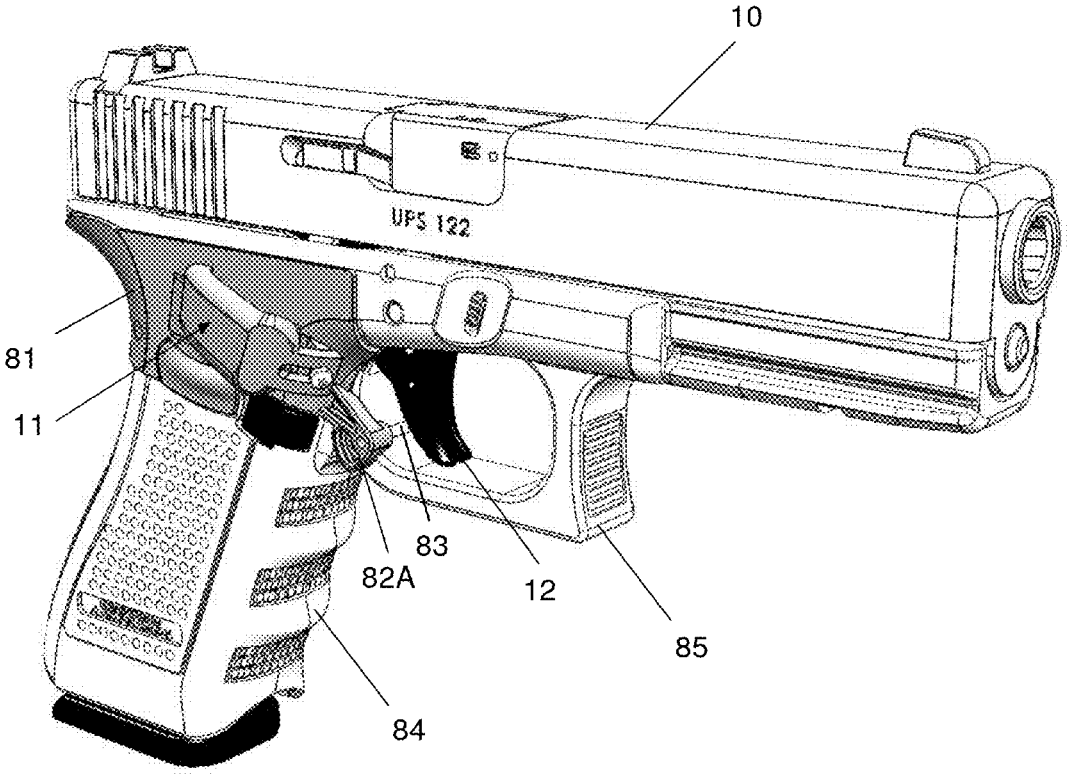
Figure 8C:
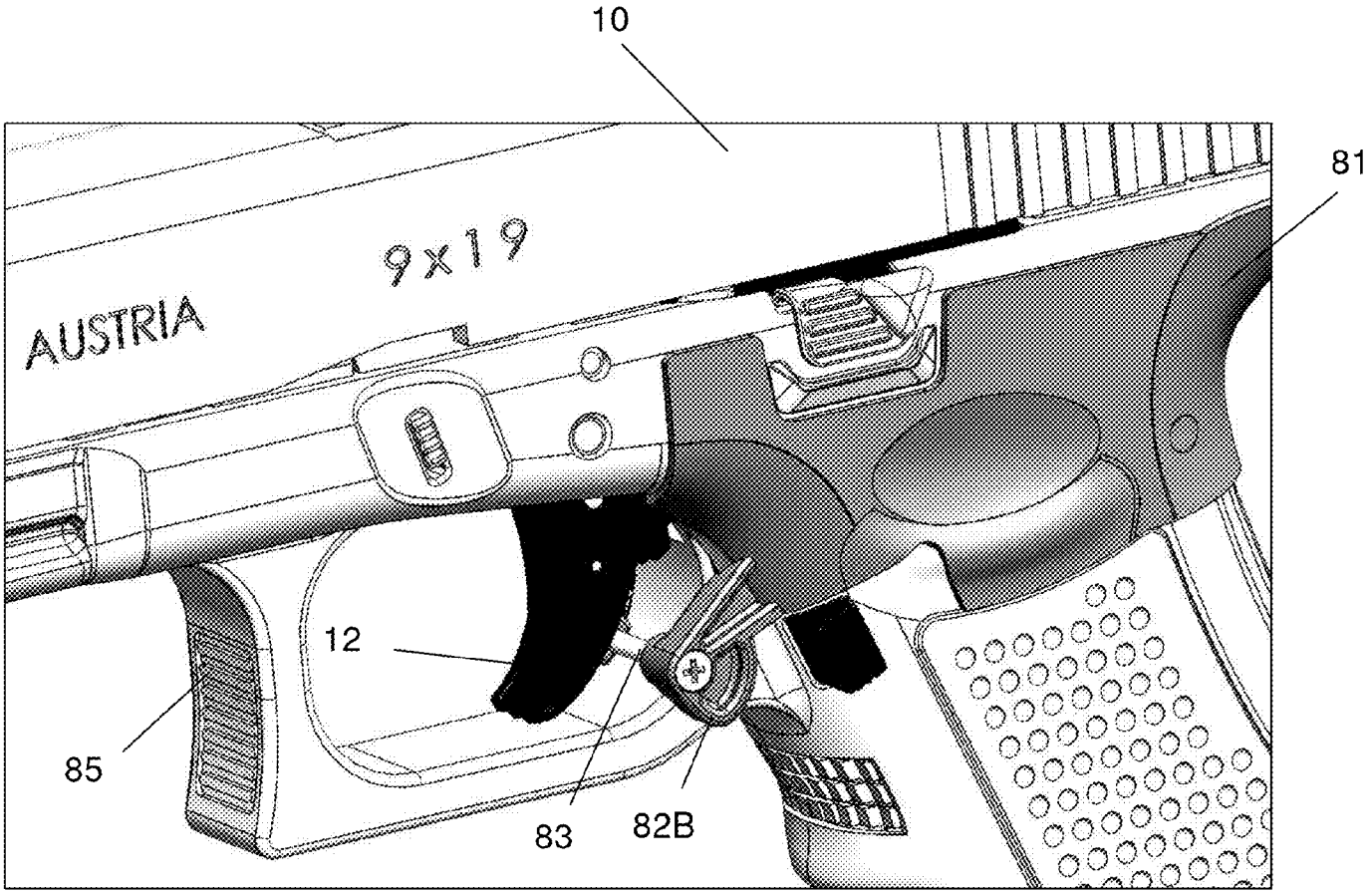

According to some embodiments of the present invention, the adjustable grip extender 11 can be attached to the firearm 10 using an attaching arrangement 81, as shown with respect to FIGS. 8A-8C. In this embodiment, the attaching arrangement 81 is made of a relatively thin layer of either a rigid or flexible material such a polymer or metal (e.g., a having thickness of about 1-2 millimeters) on which the adjustable grip extender 11 is embedded. The attaching arrangement 81 is having an open shape that surrounds the firearm's handle 84 and on which the adjustable grip extender 11 is embedded. The open shape having two ends that are facing each other (as indicated by numerals 82A and 82B), thus the attaching arrangement 81 is formed in such a way that it wraps or covers, at least partially, the handle 84 of the firearm 10. The attaching arrangement 81 is secured to the firearm 10, by fastening the ends of the attaching arrangement 81 (as indicated by numerals 82A and 82B) with a securing member such as screw 83 that connects both ends 82A and 82B. In this embodiment, in order to connect the ends 82A and 82B, screw 83 passes through the trigger guard 85 of firearm 10 and behind the trigger 12, such that it avoids any interruption to the operation and movement of the trigger 12 while shooting with the firearm 10. The inner surface of the attaching arrangement 81 should match to the outer surface of the handle 84 in order to obtain an optimal attaching result. Although, the attaching arrangement 81 is made of a single element, other configuration of similar attaching arrangements can be provided but with more than one element, for example, as described herein after with respect to FIGS. 9A-9D.

According to another embodiment of the present invention, the adjustable grip extender 11 can be attached to the firearm 10 using an attaching arrangement that includes two separate elements 91A and 91B, as shown with respect to FIGS. 9A-9D. In this embodiment, the elements 91A and 91B of the attaching arrangement are made of a relatively thin layer of either a rigid or flexible material such a polymer or metal (e.g., a having thickness of about 1-2 millimeters). In this embodiment, the adjustable grip extender 11 is embedded on element 91A. Element 91A of the attaching arrangement is formed in such a way that it essentially wraps or covers the entire one side of the handle 84 of firearm 10. Element 91B of the secure is formed in such a way that it wraps or covers, at least partially, the other side of the handle 84 of firearm 10.

Figure 9A:
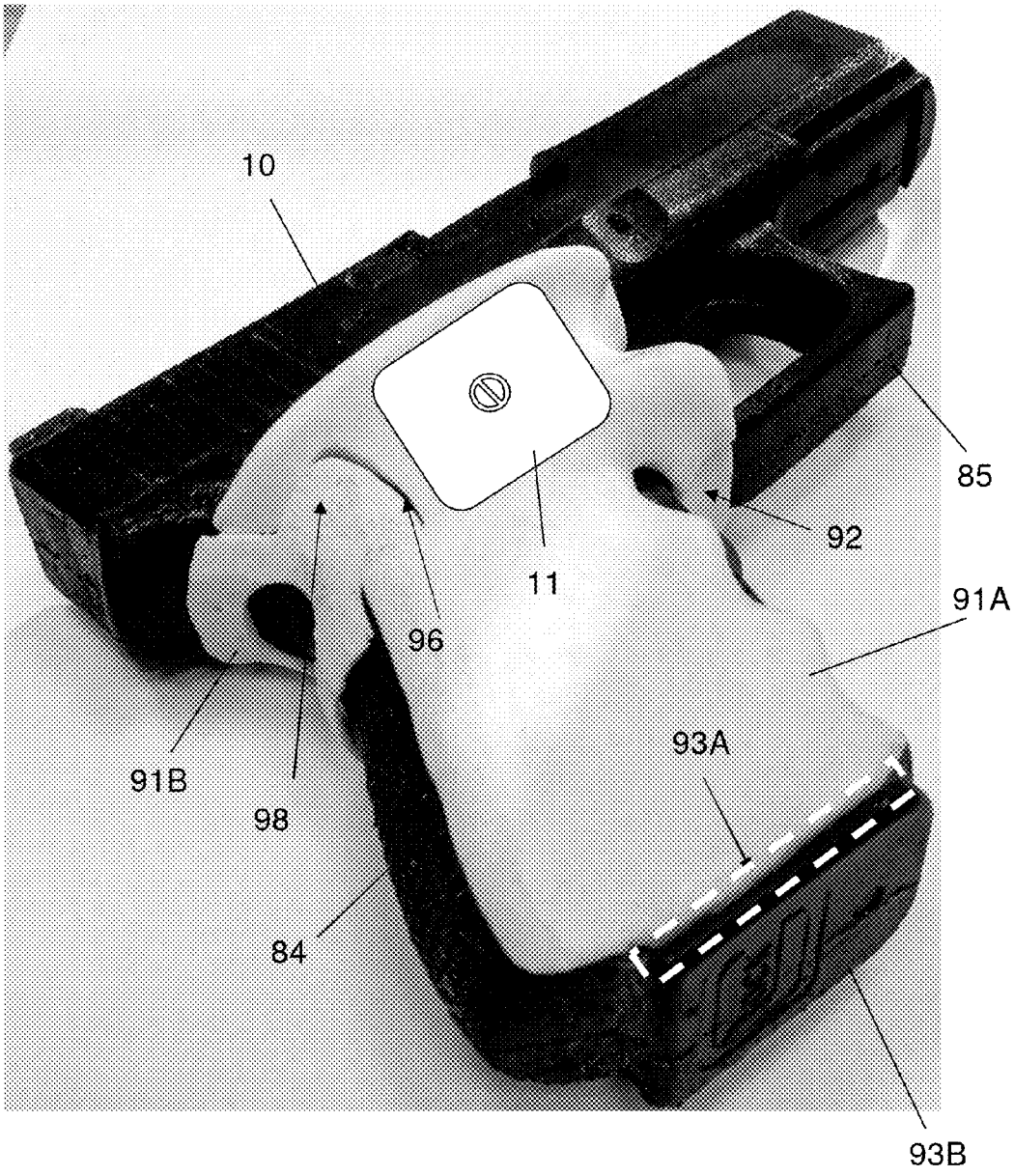
FIGS. 9A-9B show an exemplary attaching arrangement that attaches the adjustable grip extender to the firearm, according to another embodiment of the present invention.

Both elements 91A and 91B are configured to be connected together around the handle 84 of the firearm 10 by fastening or engaging means such as one or more screws, and/or other suitable type of connectors. For example, elements 91A and 91B are secured to the firearm 10, by connecting them together in one end (at about the trigger area) with a securing member such as screw 94 in a similar manner to the screw 83 of attaching arrangement 81 (i.e., screw 94 passes through the trigger guard 85 of firearm 10 and behind the trigger 12, in order to avoid any interruption with the operation and movement of the trigger 12 while shooting with the firearm 10). FIG. 9D shows an insertion hole 95 in element 91B through which screw 94 is inserted in order to secure elements 91A and 91B together around the handle 84. In this configuration, element 91A includes an optional screw support member that can be used to facilitate or enhance the tightening of screw 94 while connecting elements 91A and 91B.

On the other end (e.g., in this configuration it refers to the end that is located on one of the sides of the handle 84 at about the rear side of the firearm 10) element 91A and 91B are connected by corresponding portions at each one of them that are adapted to be engaged as indicated by numerals 96 and 98. In this embodiment, portion 98 is configured in a conical shape (as can be easily seen in FIG. 9D) that fits a corresponding opening (i.e., portion 96 as can be easily seen in FIG. 9C) in element 91A (the engagement of both portions 96 and 98 is shown in FIG. 9A). The conical arrangement provides an enhanced connection that eliminates the need to use a screw or any other additional fastening means. The inner surface of each element 91A and 91B (see FIGS. 9C and 9D) should match the outer surface of the corresponding side of the handle 84 in order to obtain an optimal attaching result.

Figure 9B:
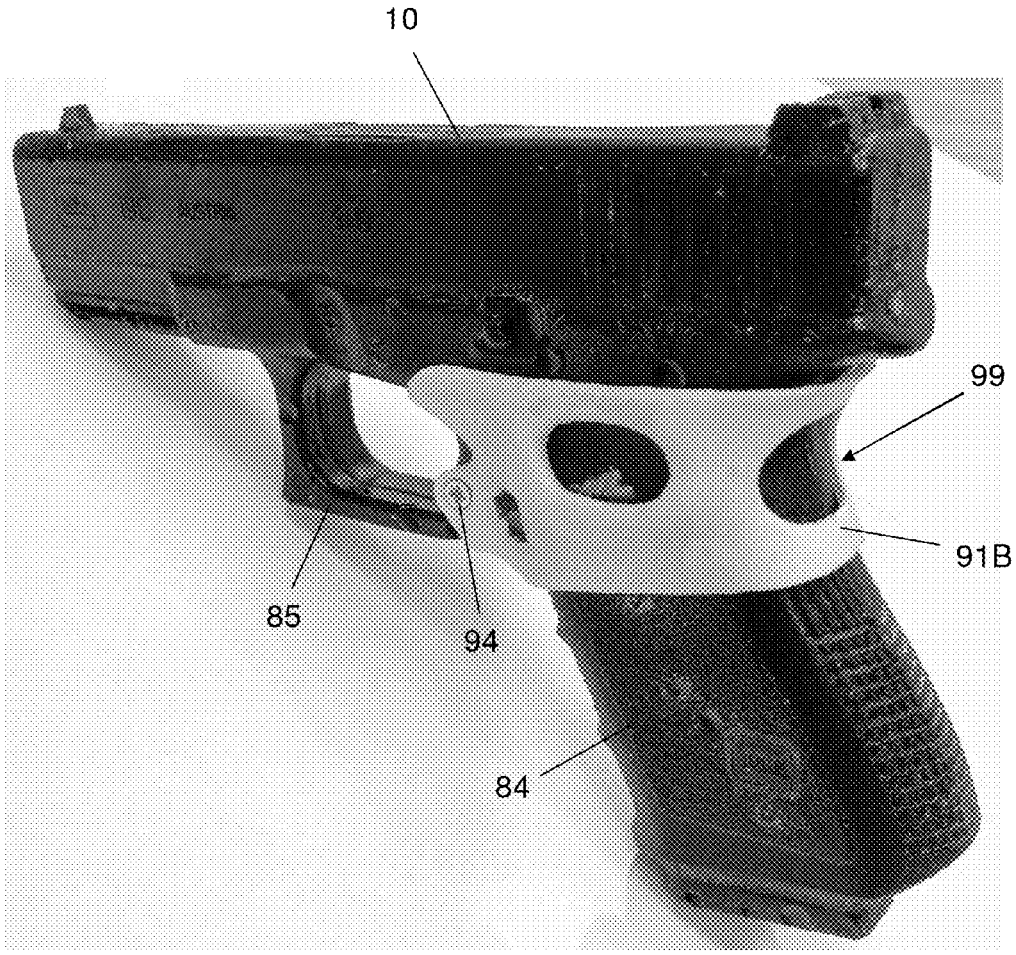
Figure 9C:
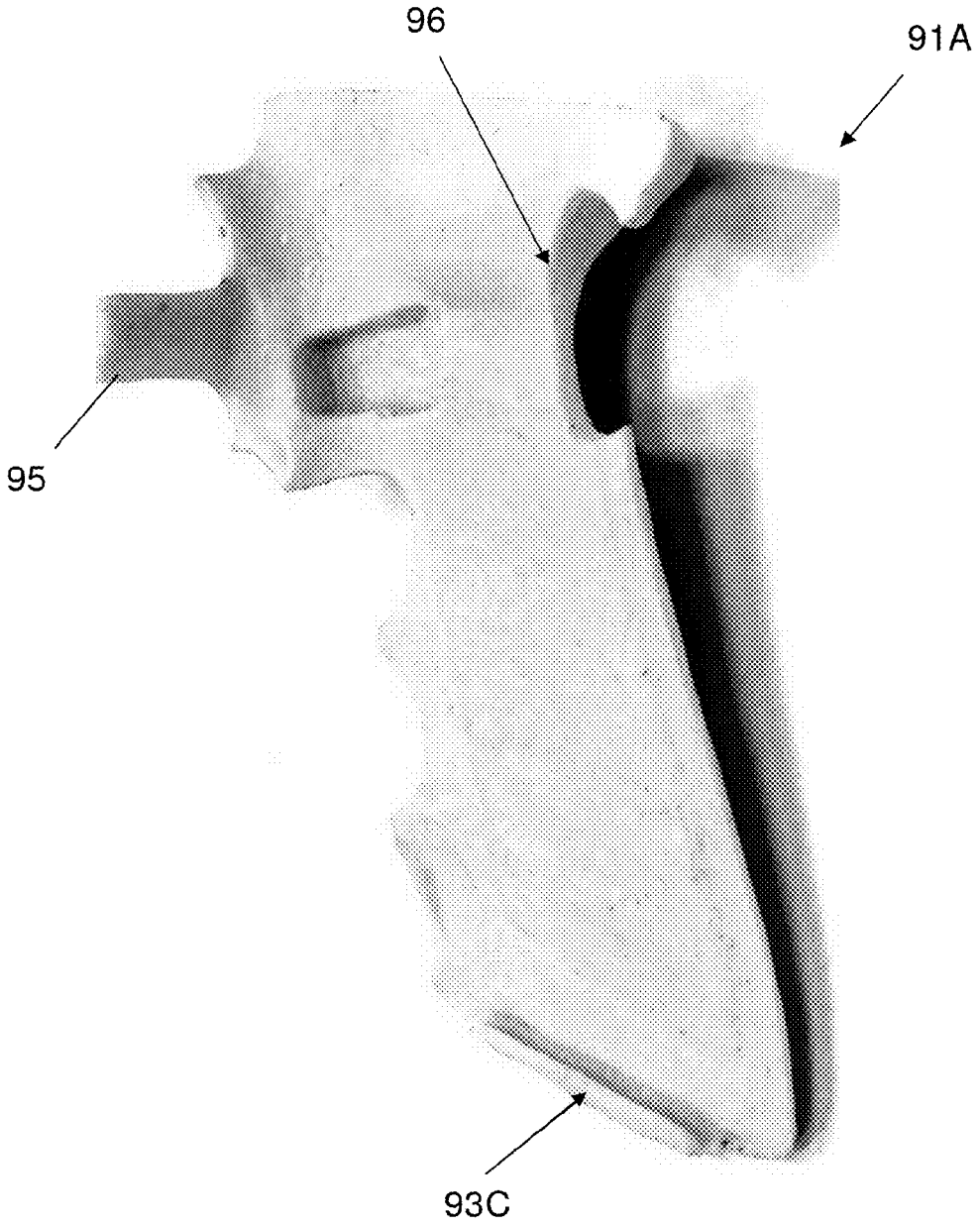
FIG. 9C show an inner view of a first element of the exemplary attaching arrangement of FIGS. 9A and 9B, according to another embodiment of the present invention.
Figure 9D:
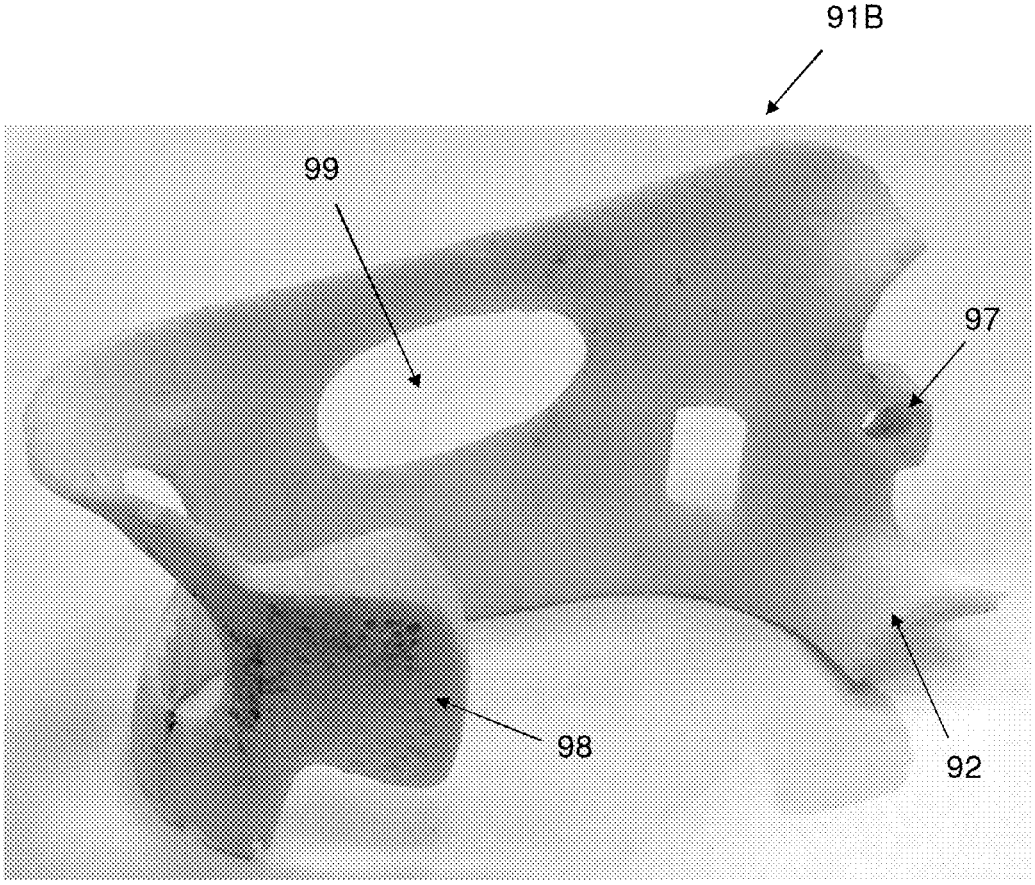
FIG. 9D show a perspective view of a second element of the exemplary attaching arrangement of FIGS. 9A and 9B, according to another embodiment of the present invention

According to an embodiment of the invention, in order to enhance the attachment of the attaching arrangement to the firearm, element 91A may further include an insert 93C (FIG. 9C) that is adapted to be inserted into a relatively narrow slit (usually less than 1 millimeter) that exists between the firearm's magazine (as indicated by numeral 93B) and the magazine housing at the bottom of the handle 84 while the magazine 93B is inserted (as indicated by numeral 93A in FIG. 9B).

According to some embodiments, the attaching arrangement such as 81 or as defined by the elements 91A and 91B may further include ergonomic openings such as indicated by numeral 99 (in FIGS. 9B and 9D) adapted to fit portion of the hand or fingers of the user while gripping the firearm. Such openings are used to ergonomically enhance the holding of the firearm by the user's hand.

Optionally, the aforementioned attaching arrangements may include an extended member that extends beneath the trigger guard 85 of firearm 10, e.g., as indicated by numeral 92 in FIGS. 9A and 9D. The extended member can be used to reinforce the securement of the attaching arrangement.

It is important to mention that in order to shoot a firearm accurately, it is important that the pad near the tip of the trigger finger come straight back, without moving (i.e., "shaking") the firearm left or right. The adjustable grip of the present invention helps the user to use the firearm in a correct manner, as it may completely reduce the user tendency to pull shots to the right or left.

The structural features of the suggested adjustable grip extender of the present invention is intended to replace the common side panels of a firearm (or attached or mounted thereto) to improve proper placement of the trigger finger on the trigger. Furthermore, it provides a much better grip of the firearm. Due to its structure the adjustable grip of the present invention may completely eliminate the tendency to move the firearm (usually right or left) while a user pulls the trigger, as the structural shape of the adjustable grip leaves almost no empty space between the user's hand and the side panel. This provides a much accurate result. While using a firearm, an enhanced grip with personal configuration and fitting, enables the user to improve target accuracy and consistency. The adjustable grip allows the user to grab the side panel of the firearm with all of his palm (and fingers except, of course, the portion of the trigger finger that is placed on the trigger).

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. An adjustable grip extender for a firearm, comprising:

a) an elevating mechanism, the elevating mechanism having a moveable portion and a fixed portion, the movable portion, with respect to the adjustable grip extender, is positioned above the fixed portion, wherein the moveable portion pivotally connects to the fixed portion in such a way that the moveable portion moves angularly with respect to the fixed portion, the fixed portion has a bottom surface attached to the firearm's handle and is positioned on the firearm's handle to allow a user's trigger finger to rest on the moveable portion for positioning the user's trigger finger's distal portion directly in front of the firearm's trigger and substantially perpendicular to the trigger; and b) an adjustable mechanism for setting the moveable portion's elevating degree in relation to a fixed position, by changing the moveable portion's angular position relative to the fixed portion, the adjustable mechanism having a screw with a head section and a threaded section, wherein the head section connects to the moveable portion through a corresponding opening at the moveable portion and the threaded section screws into a corresponding nut housing located at the fixed portion, thus the elevating degree is set by turning said screw in a right or left direction, such that only the turning of said screw will result in lowering or raising said moveable portion.

2. The adjustable grip extender according to claim 1, in which the screw is attached to the elevating mechanism in such a way that the distal end of said screw is screwed into the corresponding nut housing located on the fixed portion, while being threaded through the corresponding opening on the moveable portion.

3. The adjustable grip extender according to claim 1, in which the corresponding nut housing axially connects to the fixed portion, thereby allowing the movement of said screw while lowering or raising the moveable portion when turn the screw left or right.

4. The adjustable grip extender according to claim 1, in which the elevating mechanism is covered with an elastic material shaped in an ergonomic manner for a user's hand, and allowing the user's trigger finger to return substantially to the same position after each firing.

5. The adjustable grip extender according to claim 1, in which a standalone side panel provided with the adjustable grip extender replaces the firearm's original handle cover or side panel portion.

6. The adjustable grip extender according to claim 1, in which the adjustable grip extender attaches to an original or a standard factory side panel of the firearm using any suitable attaching arrangement made of at least one thin layer of rigid or flexible polymeric or metal material.

7. The adjustable grip extender according to claim 6, in which the attaching arrangement is selected from the group consisting of: securing screws, clips, tension clips, or any combination thereof.

8. The adjustable grip extender according to claim 6, in which the attaching arrangement has an open shape that surrounds the firearm's handle where the adjustable grip extender is embedded, the open shape has two ends that face each other, thus the attaching arrangement (a) wraps or covers, at least partially, the side panels of the handle, and (b) is secured to said firearm, by fastening the attaching arrangement's ends with a securing member that connects said ends.

9. The adjustable grip extender according to claim 8, in which the securing member is a screw that passes through a trigger guard of the firearm and behind the trigger of said firearm, such that said screw avoids any interruption to the operation and movement of said trigger while shooting with said firearm.

10. The adjustable grip extender according to claim 8, in which the attaching arrangement includes an insert adapted to be inserted into a slit that exists between the firearm's magazine and magazine housing at the bottom of the firearm's handle while the magazine is inserted.

11. The adjustable grip extender according to claim 1, in which the firearm can be manufactured with said adjustable grip extender integrated thereon.

12. The adjustable grip extender according to claim 1, in which the firearm is selected from the group consisting of handguns, revolvers, semiautomatic handguns, rifles, shotguns, and any other firearm or similar weapons having a side panel suitable to attach said adjustable grip extender thereon.

13. The adjustable grip extender according to claim 1, in which the elevating mechanism is made of rigid and/or semi rigid material(s).

14. The adjustable grip extender according to claim 1, in which the elevating mechanism comprises at least a blocker for limiting the elevation of the moveable portion, wherein said blocker is at one side of the distal end of said fixed portion and extends into a corresponding slit opening located at the distal end of the moveable portion, such that an engagement of said blocker within said slit opening, limits the elevation of said moveable portion.

15. The adjustable grip extender according to claim 1, in which the adjustable grip extender's outer shape allows the trigger finger to be positioned on the trigger.

16. The adjustable grip extender according to claim 1, in which the structural shape of said adjustable grip extender leaves substantially no empty space between the user's hand and a side panel, the substantially no empty space substantially eliminating the tendency to move the firearm right or left while the user pulls the trigger of said firearm.

17. The adjustable grip extender according to claim 1, in which the outer shape of said adjustable grip extender is configured to allow the user to grab the firearm's side panel with one of the user's palm and fingers from one of the user's hands, except the portion of the trigger finger that is placed on the trigger.

* * * * *